United States Patent [19]

Lewis

[11] Patent Number: 4,737,279

[45] Date of Patent: Apr. 12, 1988

[54] SKIMMER ADAPTOR FOR SUCTION-SIDE POOL CLEANERS

[75] Inventor: Kenneth Lewis, South Gate, Calif.

[73] Assignee: Rainbow Lifegard Products, Inc., El Monte, Calif.

[21] Appl. No.: 27,399

[22] Filed: Mar. 18, 1987

[51] Int. Cl.[4] ..... E04H 3/20

[52] U.S. Cl. ..... 210/169; 210/416.2; 134/167 R; 4/490

[58] Field of Search ..... 210/169, 416.2, 241, 210/242.1; 4/490; 134/167 R; 15/1.7

[56] References Cited

U.S. PATENT DOCUMENTS

| | | | |
|---|---|---|---|
| 2,980,256 | 4/1961 | Nash | 210/169 |
| 3,252,576 | 5/1966 | Miller | 210/169 |
| 3,306,448 | 2/1967 | Baker | 210/121 |
| 3,443,264 | 5/1969 | Miller | 210/169 |
| 3,481,470 | 12/1969 | Valois | 15/1.7 |
| 3,701,427 | 10/1972 | Howard | 210/169 |
| 4,154,679 | 5/1979 | Farage | 210/169 |
| 4,348,281 | 9/1982 | Perry et al. | 210/169 |
| 4,426,286 | 1/1984 | Puckett et al. | 210/169 |
| 4,454,035 | 6/1984 | Stepan | 210/169 |
| 4,643,217 | 2/1987 | Frentzel | 239/572 |

*Primary Examiner*—Richard V. Fisher
*Assistant Examiner*—Coreen Y. Lee
*Attorney, Agent, or Firm*—Christie, Parker & Hale

[57] ABSTRACT

A strainer basket for a swimming pool having a basket top closure affording two flow paths thus-through to the basket, one via a coupling for a suction hose which is so disposed that the hose can be introduced to the skimmer through a lateral throat at the pool surface, and the other via a weir-gated enclosure carried by the basket closure. The relative flow area of these flow paths is controllable by a valve mechanism.

10 Claims, 4 Drawing Sheets

Fig. 2
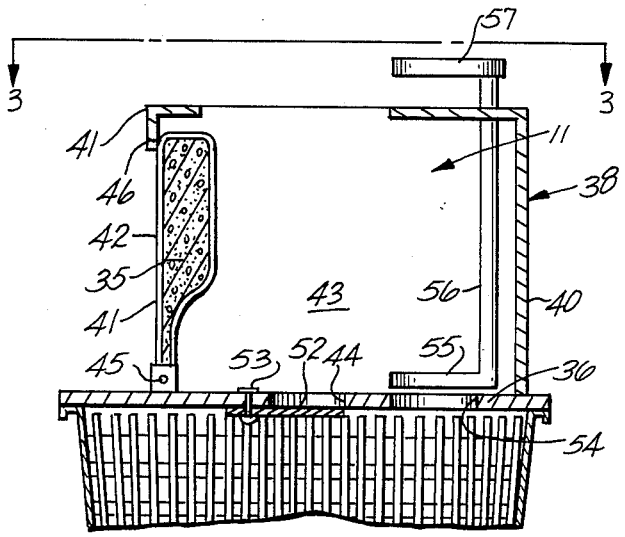
Fig. 4
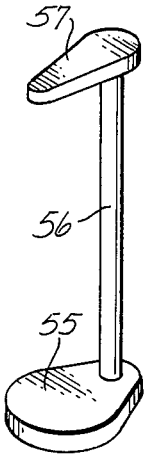
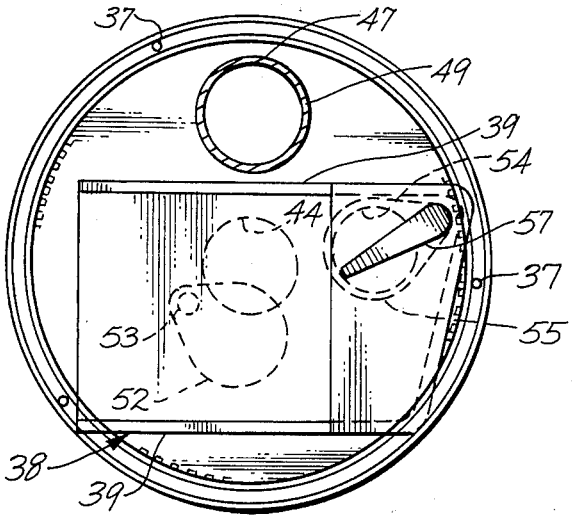
Fig. 3

SKIMMER ADAPTOR FOR SUCTION-SIDE POOL CLEANERS

FIELD OF THE INVENTION

This invention relates to the cleaning of swimming pools. More particularly, it pertains to an accessory for pool skimmers which adapts a skimmer for convenient cooperation with a pool cleaner which operates by connection to the suction side of a pool circulation pump.

BACKGROUND OF THE INVENTION

The Environment of the Invention

This invention preferably is embodied in an accessory device for swimming pool skimmers.

A swimming pool skimmer is a device which is mounted in the wall of a swimming pool adjacent the free surface of the water in the pool. The principal function of a skimmer is to remove leaves and other floating debris from the pool surface as the pool water circulation system is operated; the skimmer is a component of the circulation system.

A swimming pool water circulation system includes the pool itself, a motor driven pump, a flow duct from the pool to the inlet or suction side of the pump, a return flow duct from the discharge or pressure side of the pump to the pool, and a filter unit in the return flow duct. If desired, a water heater can be installed in the return duct. The filter is of the kind which removes sand, dust and other finely divided solid matter from water passed through it. Pool filters are not well suited for the removal from water of larger things such as leaves, flower petals, pine needles and the like. Therefore, it is now common to equip swimming pools with skimmers for the removal from water entering the return flow duct to the pump of leaves and the like, which things often float on the surface of the pool.

While skimmers are manufactured by many firms, they now generally have a common design philosophy. A typical skimmer, according to prevailing design philosophy, defines a vertically elongate chamber which has a lower basket portion, a central plenum portion, and an upper chimney portion which is closed by a removable cover. A foraminous basket, having a selected pore size, is supported across the top of the basket cavity so the bottom of the basket is above the bottom of the cavity. A throat extends laterally from the plenum to a principal inlet opening to the skimmer; that opening is square or rectangular and is defined in a vertical plane. A coupling for a flow pipe, and often two such couplings, is located at the bottom of the basket cavity of the skimmer. The skimmer is built into the pool so that the throat inlet opening is centered at the optimum water level in the pool, which level normally varies one to two inches or so above and below the optimum level; the opening is sufficiently high to encompass this range of water levels. The cover for the skimmer chimney is placed flush with a deck of other surface around the pool. The throat is partially submerged if the pool is properly filled, and so the skimmer basket cavity and the lower part of the plenum are filled with water when the pool is filled.

The flow duct from the pool to the suction side of the pool circulation pump is connected to the bottom of the basket cavity. When the pump is operated, it takes in water from the skimmer. The water enters the skimmer from the pool through the throat, carrying with it leaves and the like which float on the water surface in the civinity of the throat opening. Water entering the skimmer via the throat passes through the basket where the leaves and other large things are strained out by the basket. Thus, water passing to the pump is free of large pieces of debris, and the filter is better able to do for longer periods the task assigned to the filter. Debris collected in the skimmer basket is easily dealt with by removing the skimmer cover, removing the basket via the chimney, emptying the basket of collected debris, and replacing the basket.

It is also common, if not now prevailing practice, to locate a buoyant bottom-pivoted weir gate across the skimmer throat. The gate swings to and fro in response to waves in the pool, yet allows water and debris to pass over it into the skimmer, but not to pass from the skimmer back to the pool. Thus, the weir gate enhances the skimming action of the skimmer.

In many, perhaps most, of the skimmers now manufactured, a second flow connection is provided to the bottom of the skimmer body. The second connection is a main drain connection from which a pipe extends to a drain opening in the lowermost part of the pool. This connection, among other things, assures that the lower portion of the basket cavity will be filled with water even if the pool level falls somewhat below the skimmer throat, and thus the pump cannot lose its prime; it also affords a means of pumping the pool dry if need be. If such connection exists, there can be flow through it to the skimmer when the skimmer operates during periods when the pump is operated.

It is also known to provide water-powered cleaning devices for swimming pools. Such devices can be of the kind operated by pressurized water, such as automatic devices which float on the water surface or move across the bottom of the pool. Such devices receive water from the discharge side of the circulation pump, as by coupling to a port into the pool from the circulation pump, or water supplied by an auxiliary pump installed specifically to power the cleaning device. Such pressure-side cleaning devices operate to agitate the pool water, thereby to place dirt and debris in suspension for removal by the pool skimmer and filter units.

Pool cleaning devices which operate on pump suction are also known; they include vacuum heads which are coupled to long poles and moved manually across the pool bottom, and they also include automatic devices which move across the pool bottom—the former are used for short periods, whereas the latter can be operated for long periods measured in hours or days. Such devices are coupled by flexible suction hoses to the circulation pump inlet via the pool skimmer; they operate to suck from the pool bottom accumulations of dirt, leaves and the like, and to introduce them to the pool filter for removal there. It is the latter class of pool cleaning devices with which this invention is cooperable; more particularly, this invention has greatest utility with suction-side automatic pool cleaners, while also being useful with manually controlled cleaners such as vacuum heads.

As noted, suction-side pool cleaners are operated by connection to the suction-side of a pool circulation pump by connection of a suction hose to the pool skimmer. The suction hoses commonly used, while flexible, are not readily bent sharply at right angles. Therefore, such hoses are coupled to the pool-to-pump return line via the skimmer through the top of the skimmer, i. e., through the skimmer chimney upon removal of the chimney cover; such connections are made either after removal of the skimmer basket (in which case the coarse straining function of the basket is lost) or to special connections inside the skimmer which preserve the function of the basket. In other instances, the hose may be connected to a special port defined adjacent the skimmer throat opening in a side wall of the pool; this can be done where a specially designed skimmer was or is built into the pool, in which case a skimmer accessory according to this invention is not so useful. However, very few pool skimmers having such special hose connection features now exist. Thus, the usual situation, addressed by this invention, involves a typical skimmer, as described above.

Where the suction-side pool cleaning device is a vacuum head moved manually across the pool bottom, it is not overly hazardous to connect the cleaning suction hose to the skimmer through the skimmer chimney. This is because such cleaners are used for short periods, it is apparent they are being used, and so the presence of an open chimney and a hose extending out of the pool and over the pool edge to the chimney are hazards which can be accepted and warned against. Even so, the skimmer is disabled from skimming and coarse straining during such periods. A more serious set of circumstances exist where the suction-side cleaning device is an automatic device whose proper and effective use requires connection to the skimmer for hours or perhaps days. In such cases, the open chimney and the exposed hose over the pool edge can be serious hazards. Also, it is undesirable to forego the benefits of a skimmer weir gate and strainer basket for extended periods, especially the latter.

Thus, a need exists for equipment which can be used readily and conveniently with existing conventional skimmer structures, of which there are many thousands in place, to overcome the hazards and functional limitations which otherwise exist when an automatic suction-side pool cleaner is in use. This invention addresses and fills that need.

Review of the Prior Art

U.S. Pat. No. 4,154,679 describes equipment which can be used in existing skimmer housings, but which only partially address the need identified above. Its use with suction-side pool cleaners, manual or automatic, requires the cleaner suction hose to be introduced to the skimmer through the chimney after removal of the chimney cover. It leaves unaddressed the problems of an open skimmer and an exposed suction hose, but does retain the coarse straining functions of the skimmer during pool cleaning operations.

U.S. Pat. Nos. 3,252,576 and 3,443,264 describe skimmer basket arrangements which, when used in connection with suction-side pool cleaners, require an open chimney. U.S. Pat. Nos. 2,980,256 and 3,628,664 have similar characteristics and also sacrifice the skimming function of the weir gate during pool cleaning operations.

U.S. Pat. Nos. 3,306,448 and 3,701,427 describe skimmer arrangements which, during pool cleaning operations, either bypass the skimming and the straining functions of the skimmer or disable the skimming function while retaining the straining function of a skimmer basket.

U.S. Pat. No. 3,508,661 pertains to a special skimmer rather than to a skimmer of the kind widely now used.

SUMMARY OF THE INVENTION

This invention addresses and fills the need identified above. It provides an accessory for skimmers of the kinds now widely used. Its use is simple and easy to effect. Its use enables the performance of pool cleaning operations with suction-side cleaners without the hazards of open skimmer chimneys and exposed suction hoses while also providing skimming and coarse straining functions in the skimmer. A product according to this invention can be used with existing skimmer baskets, or it can provide its own skimmer basket.

Generally speaking, this invention provides a pool skimmer accessory which is useful with a pool cleaner which operates by being coupled to the suction-side of a pool circulation pump. The accessory comprises an assembly which is mountable across the top of a skimmer basket to close the basket top. The assembly is sized to fit within a chamber above the location of the basket in a skimmer housing adjacent an inlet throat to the chamber. The assembly includes a plate which is mountable across the skimmer basket for closing the basket top. An upright enclosure is mounted on an upper surface of the plate and is sized to occupy a substantial portion of, but less than all of the area of the plate. The enclosure has a substantially open and substantially vertical side which defines an opening to the enclosure. A buoyant weir gate member is pivotally mounted to the enclosure adjacent the plate and adjacent the lower edge of the gate member. The gate member substantially closes the opening when the gate member is disposed in the plane of the opening. A first flow aperture is defined through the plate from the interior of the enclosure. A second flow aperture is defined through the plate outside the enclosure. The assembly also includes connection means coupled to the plate at the second aperture and adapted for connection thereto of a liquid flow duct from a suction-type pool cleaner upon introduction of the flow duct to the connection means through the throat of the skimmer.

DESCRIPTION OF THE DRAWINGS

The above-mentioned and other features of this invention are more fully set forth in the following detailed description of the presently preferred and other embodiments of this invention; such description is presented with reference to the accompanying drawings wherein:

FIG. 2 is a fragmentary vertical cross sectional elevation view of the skimmer accessory shown in FIG. 1;

FIG. 3 is a simplified view taken along line 3—3 of FIG. 2.

DESCRIPTION OF THE ILLUSTRATED EMBODIMENTS

Figure 1:
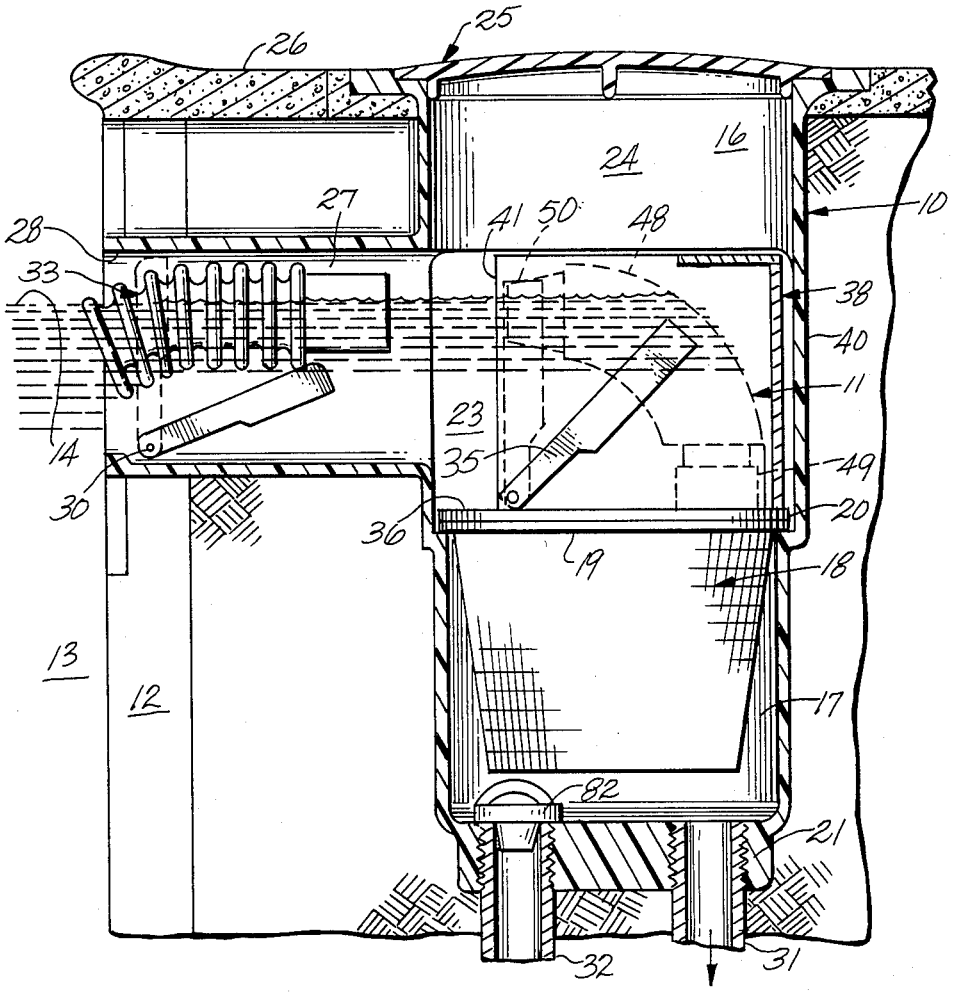
FIG. 1 is a cross-sectional elevation view of a skimmer housing mounted in the structure of a swimming pool and showing a skimmer accessory according to this invention in right side elevation view.

FIG. 1 is a vertical cross-sectional elevation view through a skimmer housing 10 of conventional design in which an accessory assembly 11 according to this invention is disposed in its operative position. The skimmer housing is located in the ground adjacent to a side wall 12 of a swimming pool 13 having a normal water surface 14. As is known, the skimmer housing defines therein a vertically disposed, substantially cylindrical chamber 16 having, at a lower portion thereof, a basket cavity 17 in which is disposed a strainer basket 18 having foraminous sides and bottom and an open top. The strainer basket is supported by cooperation of a peripheral flange 19 with an upwardly open shoulder 20 defined by the contour of the skimmer housing circumferentially of the upper end of basket cavity 17. The dept of the basket cavity is such that when basket 18 is properly disposed on shoulder 20, the lower extent of the basket is spaced a desired distance above a bottom wall 21 of the skimmer housing.

A plenum space 23 is defined in the interior of the skimmer housing above the basket cavity as a central portion of chamber 16. The upper extent of chamber 16 is defined as a chimney 24 which has an open upper end closable by a removable cover 25. The upper extent of the skimmer housing and the top surface of cover 25 are substantially flush with the upper surface of a deck 26 or pavement located adjacent the edge of pool 13.

Skimmer housing 10 also defines a hollow throat 27 which extends laterally from plenum 23 through pool wall 12 to an open end which defines a principal water inlet opening 28 to the interior of the skimmer housing. The throat has a square or rectangular transverse cross-sectional configuration and opens to plenum 23 somewhat above the operative position of strainer basket 18 as shown in FIG. 1. Preferably a buoyant weir gate 29 is pivotally disposed in throat 27 in a known manner so as to substantially close the cross-sectional area of the throat when the weir gate is in an upright position about its pivot 30. The normal upright position of weir gate 29 is shown in dashed lines in FIG. 1.

At least one, and preferably two, threaded holes are formed through the bottom wall 21 of the skimmer housing. A water circulation return line 31 is connected to the skimmer housing at one of these holes to receive water from the bottom of the basket cavity 17 and to conduct such water to the inlet or suction-side of a pool circulation pump (not shown) in a known matter. The pump has its discharge side connected to a pool filter unit (not shown) where finely divided solids are removed from water introduced to the filter. From the filter, circulation water is piped back to the pool where it is introduced to the pool through one or more inlet ports (not shown) located at desired locations of the pool. Circulation water is returned to the pool from the pump in such a manner that, as the circulating water is introduced into the pool, water in the pool circulates around the pool to sweep any leaves and the like floating on water surface 14 past inlet opening 28 to skimmer throat 27. Surface water in the pool adjacent the throat is drawn into the skimmer housing over the top of the weir gate. Any floating debris passing the weir gate is caught in strainer basket 18 and so is removed from the water flow to the pump, thereby leaving to the pool filter its assigned task of removing solids which are sufficiently small to pass through the openings defined in the foraminous strainer basket.

As shown in FIG. 1, it is also common to connect to the bottom of basket cavity 17, at the lower wall of the skimmer housing, a second pipe 32 the other end of which is connected to a drain opening disposed in the lowermost extremity of pool 13. During normal operation of the skimmer, water can enter the skimmer chamber through throat 27 and also through main drain pipe 32. Water entering the skimmer chamber through the main drain pipe does not pass through skimmer basket 18.

When skimmers of the kind shown in FIG. 1 are used with suction-type pool cleaning devices, whether of the manual kind or the automatically operating kind, a flexible suction hose 33 (see FIG. 1) is connected, usually directly, to the return line 31 connection of the skimmer. Most commonly, this is done by inserting the end of the suction hose into the interior of return line 31 or into a seat defined in the bottom wall of the skimmer housing coaxially of the return line for such purpose. Usually the suction hose is so connected in the skimmer housing through chimney 24 after removal of skimmer basket 18 from its operative position within the skimmer housing. During such time as the suction-type cleaning device is coupled to the skimmer, the skimmer chimney is open by reason of the removal of cover 25; the suction hose is lead to the interior of the skimmer across the decking or the like from the pool. The presence of the suction hose above the deck, and also the open chimney of the skimmer during such circumstances presents a hazard, particularly to children who may be moving about in the vicinity of the skimmer. If the cleaning device being used in a manually operated device, these hazards are controllable because there normally is an adult present and operating the cleaning device; such person can warn children to be careful of the open chimney and the exposed suction hose. On the other hand, where the cleaning device coupled to the skimmer is an automatic device, the suction hose may be connected to the skimmer for extended periods during which there may be no adult or other competent person in the vicinity to warn children and the like of the hazards of the open skimmer chimney and the exposed suction hose. Often automatic pool cleaning devices are used at night and the presence of open skimmer chimney and exposed hose can be a hazard even to an adult who may have reason to be moving about the pool.

It is also known to lead the suction hose from a suction-type pool cleaning device to its suction connection with return line 31 through the throat of the skimmer rather than through chimney 24. While such a practice does not present the hazard of an open chimney or exposed hose on the pool decking, it is inconvenient to do so and not consistent with good useful life of the suction hose itself. Flexible suction hoses of the kind typically used with swimming pools, while flexible, are not readily bent at sharp angles and so this technique for coupling the suction hose of a pool cleaning device to pool return line 31 is not recommended. Moreover, where such techniques are used, it will be apparent that the presence of the suction hose in skimmer throat 27 interferes with the proper operation of weir 29 and therefore disables the skimming function of the skimmer. Regardless of whether the suction hose is lead to engagement with return line 31 through throat 27 or through chimney 24, it is apparent that such connection of the suction hose to the pool return line causes the loss of both the skimming and straining functions provided by weir gate 29 and strainer basket 18, respectively.

The loss of skimming and straining functions during use of automatic suction-type pool cleaning devices is undesirable because, as such devices are operated, water is always being returned to the pool by the circulating pump. Suction-type automatic cleaning devices typically operate on the bottom of the pool and loss of the skimming function leaves the problem of debris floating on the water surface for attention. Also, suction-type automatic cleaning devices directly suck up all debris, finely divided or not, located on the pool bottom, including leaves, twigs and the like. It is desirable that leaves and the like be removed from the water flow upstream of the inlet to the pool filter.

According to this invention, accessory 11 is provided as an adaptor for strainer basket 18. The adaptor accessory is arranged to conveniently receive suction hose 33 for flow of water into basket cavity 17 along one of two parallel flow paths possible via the adaptor. The other flow path from the plenum space of the skimmer chamber into the basket cavity is via a weir gate 35 (FIG.2) included within the adaptor. Thus, during periods in which a suction-type cleaning device is coupled to the adaptor, both skimming and straining functions are retained in the skimmer. These benefits are achieved while eliminating the hazards associated with open skimmer chimneys and exposed hoses on decks adjacent to pool edges.

Figure 6:
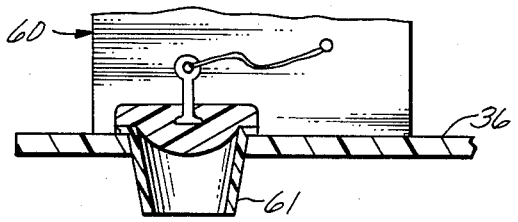
FIG. 6 is a fragmentary cross-sectional elevation view of a portion of another skimmer accessory according to this invention.

Adaptor 11 includes a base plate 36 which preferably is circular and has a diameter corresponding to the maximum diameter of strainer basket 18 at its upper peripheral flange 19. Plate 36 is coupled to the skimmer basket to substantially close the top of the basket. The coupling of the plate to the basket rim can be by conventional fasteners such as screws 37 (see FIG. 3), but more preferably the connection is of the quick disconnect kind afforded by coaction between cooperating features of the plate and the basket as is shown in FIG. 6 of U.S. Pat. No. 4,154,679, for example.

An upright enclosure 38 is carried on the upper surface of plate 36. As shown in FIG.3, the plan footprint of the enclosure on the plate is substantially rectangular and occupies a substantial portion of but not all of, the area of the plate. The enclosure is located off center of the plate. The enclosure has upright, substantially parallel side walls 39, and a back wall 40. The enclosure can have a top wall if desired. The enclosure is hollow and has an open front 41 which is substantially flat and substantially vertical, thereby providing an opening 42 into a chamber 43 defined within the enclosure.

A first flow aperture 44 is defined through plate 36 to afford flow communication from enclosure chamber 43 to the interior of strainer basket 18. Buoyant weir gate member 35 is disposed between the side walls of the enclosure and is pivoted, as at 45, between the enclosure side walls at its lower extent proximate to the upper surface of plate 36 substantially in opening 42 to the enclosure chamber. A tab 46 depends centrally of opening 39 from the upper edge of the opening to limit the weir gate to pivotal motion within the enclosure.

A second flow aperture 47, is formed through plate 36 at a location in the plate which is outside enclosure 38. Connection means are coupled to plate 36 at aperture 47 and are adapted for connection thereto of a liquid flow duct, such as suction hose 33 from a suction-type pool cleaner, lead to the interior of the skimmer housing through skimmer throat 27. As shown in FIGS. 1–3 and 5, the connection means can be defined by a flow duct elbow 48 which is connected to plate 36 via a suitable nipple 49 affixed to the plate in association with aperture 47. At its end opposite from the plate, elbow 48 defines or carries a fitting 50 configured to make a snug, mechanically secure yet readily releasable coupling engagement with a cooperating feature defined at an end of suction hose 33 in a known manner.

Valve means are mounted to plate 36 for adjusting the relative flow areas of flow apertures 44 and 47 during use of accessory 11. Two different such valve means are shown in FIGS. 2 and 3 for use jointly or alternately as desired. Thus, as shown in FIG.3, a valve plate 52 is pivotally mounted, as at 53, to the underside of plate 36 in association with aperture 44. The valve member cooperates adjustably with aperture 44 to regulate the opening of the aperture from fully open to fully closed, thereby to regulate the effective flow area of aperture 44 relative to that of aperture 47. If desired, a second separate similar valve member can be mounted to the plate in association with aperture 47. Alternatively, in a manner similar to that shown in FIG. 9, a single valve member configured for cooperation with both of apertures 44 and 47 can be provided in such manner that when the valve member fully closes aperture 44, aperture 47 is fully open, and vice versa. In addition to, or as an alternate to, valve 52 in association with aperture 44, an aperture 54 through plate 36 from chamber 43 can cooperate with a valve plate 55 disposed above plate 36. Valve plate 55 is connected to the lower end of a vertical shaft 56 which extends through a carrier bracket at the top of enclosure 38. A manually engageable actuator arm 57 is connected to the upper end of the shaft. If desired, the actuator arm can cooperate with suitable indicia on the top of the enclosure signifying the relative closure of aperture 54 by valve plate 55.

The proper position of adaptor 11 in the skimmer housing is that position of the adaptor in which the open weir gated side of enclosure 38 faces toward skimmer throat 27.

Figure 7:
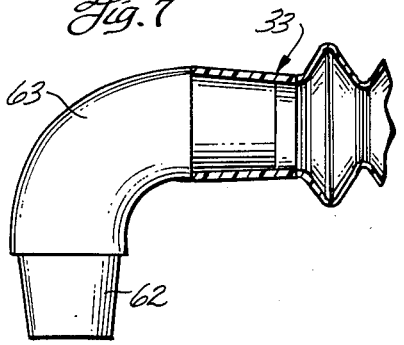
FIG. 7 is an elevation view showing a connection fitting, useful in the embodiment shown in FIG. 6, to connect a suction hose of a suction-side pool cleaning device to the skimmer accessory shown in FIG. 6.

It is desirable that the effective inlet of the flow path through plate 36 via aperture 47 be located as low in the skimmer housing as possible so that, when a suction hose to a cleaning device is not connected to the adaptor, operation of the pool circulation pump cannot result in air being sucked into the lower portion of the skimmer chamber. Accordingly, to realize this objective it is within the scope of this invention that elbow 48 can be demountable from plate 35 rather than permanently affixed to the plate. FIGS. 6 and 7 illustrate relevant portions of another adaptor 60 according to this invention. Adaptor 60 can be substantially identical to adaptor 11 except that a connection sleeve 61 is permanently carried by plate 36 in association with aperture 47. Elbow 63 has at its inlet end a cooperating fitting 62 which is matable with sleeve 61 to provide a substantially fluid tight coupling to the sleeve, but in a manner which affords ready removal of elbow 63 from the plate. In this instance elbow 63 can be essentially permanently connected to the adjacent end of suction hose 33. Thus, in adaptor 60 the effective inlet to the flow passage through aperture 47 is substantially at plate 36 itself. Since the plate is located at the top of the skimmer basket, it is unlikely that this embodiment of the invention will be subject to any problem of air being sucked into the strainer basket via aperture 47.

Inasmuch as sleeve 61 preferably extends below the bottom surface of plate 36 of adaptor 60, a flow regulating valve which cooperates with both aperture 44 and 47 is not convenient. Balancing of the flows between these apertures is most important during those times when the accessory is being used with a suction-type pool cleaning device. It is at those times that aperture 47 should be fully open and aperture 44 perhaps partially closed; when the accessory is not being used with a pool cleaning device, it is desirable that all water flow through the accessory be flow over weir gate 35 and via aperture 44 to the strainer basket. Therefore, a removable plug 64, perhaps molded of rubber or the like, is engageable with the upper end of sleeve 61 to seal the passage through the sleeve when a pool cleaning device is not coupled to the accessory. Plug 64 can be tethered to the accessory housing by a flexible line 65 connected between the housing and an eye 66 molded into the plug, e.g. A valve plate 52 can be used in conjunction with aperture 44 from the interior of the weir gated housing of accessory 60.

Figure 8:
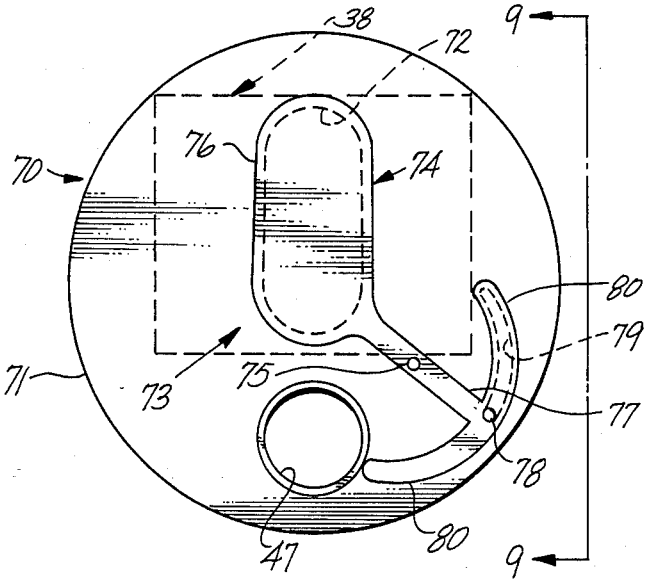
FIG. 8 is a bottom plan view of a regulating valve in a further embodiment of this invention.
Figure 9:
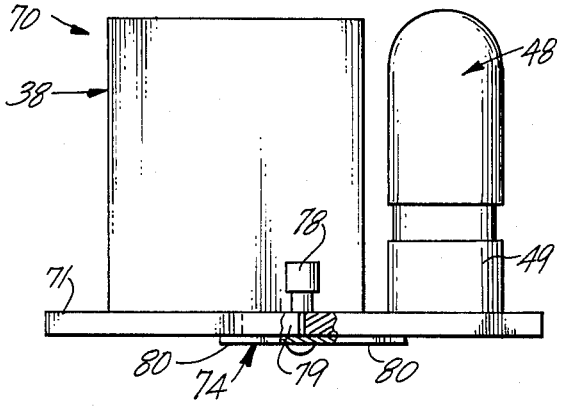
FIG. 9 is a view taken along line 9—9 in FIG. 8.

FIGS. 8 and 9 illustrate another adaptor accessory 70 according to this invention. Accessory 70 is similar to accessory 11 in that it includes a weir gated housing 38 and an elbow 48, both mounted to the top of plate 71. An aperture 47, with which elbow 48 is associated, is formed through the plate outside housing 38. Accessory 70 differs from accessory 11 in that accessory 70 has a flow aperture 72 from housing 38 through plate 71 which is not round and is larger in area than aperture 44; it includes a valve mechanism 73 which is operable from the top of plate 71 for regulating the relative effective flow areas of apertures 71 and 72 depending upon the mode of use of the accessory at any given time consistent with the characteristics of the pool circulation system and other factors. Aperture 72 is an elongate opening in plate 71; being larger than aperture 44, it is better able to pass to basket 18 large leaves and other pieces of floating or suspended debris drawn from pool 13 into skimmer housing 10.

Valve mechanism 73 includes a valve plate 74 which lies against the bottom of accessory plate 71 and which is pivotably mounted, as at 75, for movement about an axis normal to both plates. Valve plate 74 defines a valve tab 76 which is sized and configured to fully close aperture 72 when the valve plate is at one limit of its motion relative to plate 71; the geometry of the tab is defined in cooperation with the location of pivot 75 so that the tab fully closes aperture 47, and aperture 72 is fully open, when the valve plate is at its other limit of motion relative to plate 71. The valve plate has an arm 77 extends past pivot 75 to carry an actuator 78 which extends upwardly through an accurate slot 79 formed through plate 71 outside enclosure 38. The upper end of the actuator is located above plate 71 as shown in FIG. 8. Slot 79 enables the valve plate to be pivoted about pivot 75; the slot is curved to be concentric about the pivot. Arm 77 of the valve plate defines carries ears 80 which are also curved concentric about pivot 75 so that, regardless of the angular position of the valve plate relative to plate 71, one or the other or parts of both ears always close slot 76 so there is no significant water flow through the slot; water flow through slot 79 represents "leakage" relative to the desired flow through apertures 44 and 72. Valve mechanism 73 is operable without need for removal of basket from its seat 20, or without need for removal of the basket from plate 71.

During use of adaptor accessories 11, 60 or 70 in combination with a suction-type pool cleaner, it may be desirable to have substantially all flow through the skimmer housing be flow through the accessory. Thus, at such times it may be desirable to close off main drain line 32, if present, from the bottom of skimmer 10. Accordingly, in a known manner a simple plug 82 may be snugly yet removably inserted into the upper end of main drain line 32 as shown in FIG. 1.

Figure 5:
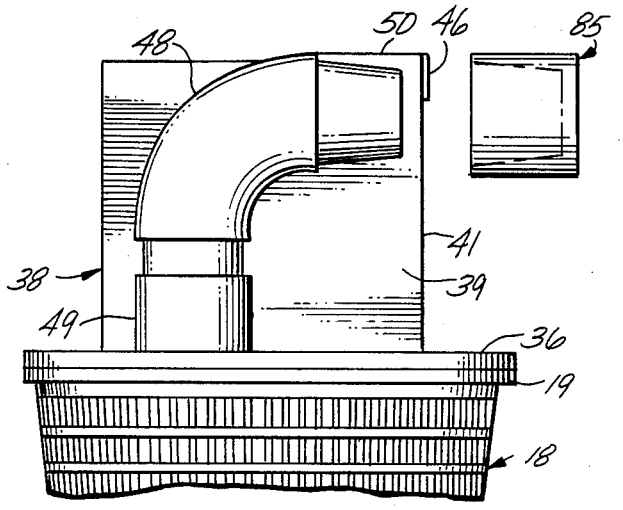
FIG. 5 is a fragmentary left side elevation view of the skimmer accessory shown in FIG. 1.

FIG. 5 shows that a skimmer adaptor accessory according to this invention can provide a suction hose connection at a place above the base plate of the accessory, such as the hose connection provided by elbow 48 which is affixed to plate 36 via nipple 49. A removable cap 85, perhaps molded of rubber or the like, can be provided to close the hose coupling 50 at the inlet end of the elbow. The cap can be used when no hose is connected to the accessory, thereby to assure the air will not be sucked into and through the skimmer basket in the event the pool water level 14 should fall below the inlet end of the elbow.

It is preferred that an adapter accessory according to this invention be fabricated, to the greatest extent feasible, out of synthetic resin plastic material, rather than metal, which resists corrosion by the chemical influences normally encountered in swimming pools.

From the foregoing description, it will be seen that this invention meets the need earlier identified above. It does so by providing, for existing skimmer housings, a skimmer basket arrangement, or an adaptor for existing skimmer baskets, which enables a suction-type pool cleaning device to be coupled to the skimmer without loss of either the course straining function of the skimmer or the function of the weir gate.

The foregoing description of different embodiments of this invention is not an exhaustive catalog of all the ways in which the invention can be practiced in structural or procedural contexts. Rather, the description is illustrative and exemplary. Workers skilled in the art to which the invention pertains will recognize and readily appreciate that other arrangements are possible within the fair scope of the invention and by which the advances made possible by the invention can be achieved. Therefore, the following claims are to be read, where proper, as having application to both those things described above and shown in the drawings, and those other things which, while not expressly described, are within the fair scope of the invention according to the principles of equivalence.

What is claimed is:

1. A pool skimmer accessory useful with a pool cleaner coupled to the suction side of a pool circulation pump, the accessory comprising an assembly mountable across the top of a skimmer basket to close the basket top and sized to fit within a chamber above the location of the basket in a skimmer housing adjacent an inlet throat to the chamber, the assembly including a plate fixedly mountable across the skimmer basket for closing the basket top, an upright enclosure on the plate having a substantially open substantially vertical side defining an opening to the enclosure, a buoyant weir gate member pivotally mounted to the enclosure adjacent the plate and the lower edge of the member, the gate member substantially closing the opening when disposed in the plane of the opening, means defining a first flow aperture through the plate from the interior of the enclosure, and a second flow aperture through the plate outside the enclosure, and connection means coupled to the plate at the second aperture and adapted for connection thereto of a liquid flow duct from a suction-type pool cleaner.

2. Apparatus according to claim 1 wherein the connection means includes means positioned to be disposed adjacent the enclosure open side in a substantially horizontal attitude for connection to a suction hose from a suctiontype pool cleaner introduced thereto via the skimmer throat.

3. Apparatus according to claim 1 including valve means adjustably mounted to the plate for selective closure cooperation with at least the first flow aperture.

4. Apparatus according to claim 1 including operator means connected to the valve means for operation of the valve means from above the plate outside the enclosure.

5. Apparatus according to claim 1 including valve means adjustably mounted for cooperation with at least the first flow aperture and operable for adjusting the relative flow areas of the first and second flow apertures.

6. Apparatus according to claim 1 wherein the connection means includes a flow elbow for cooperation between the second flow aperture and a suction hose introduced to the apparatus through the throat of the skimmer housing.

7. Apparatus according to claim 6 wherein the elbow is affixed to the plate.

8. Apparatus according to claim 6 wherein the elbow is disconnectible from the plate.

9. Apparatus according to claim 6 including means removably associable with the second aperture for closing the fluid flow path through the plate via the second aperture.

10. Apparatus useful in a swimming pool skimmer comprising a strainer basket having foraminous sides and bottom, a plate member mounted in closure relation to the basket top, means defining first and second flow aperture through the plate member to the interior of the basket, an enclosure on plate member from which the first aperture communicates, the enclosure having a substantially open side and a buoyant weir gate pivotally mounted to the enclosure substantially across, the open side, and connection means cooperatively associated outside the enclosure with the second aperture for connection thereto of a flow duct from a suction-type pool cleaner, the connection means being arranged so that when the apparatus is placed in a pool skimmer the pool cleaner flow duct can be lead substantially horizontally to the apparatus.

* * * * *